US005160187A

United States Patent [19]

Drumm

[11] Patent Number: 5,160,187

[45] Date of Patent: Nov. 3, 1992

[54] STRIP BRUSH FOR MOUNTING ON A ROTARY DRUM

[76] Inventor: Arthur E. Drumm, 14808 Hillview Rd., Marysville, Ohio 43040

[21] Appl. No.: 777,905

[22] Filed: Oct. 17, 1991

[51] Int. Cl.[5] ..... A46D 3/00

[52] U.S. Cl. ..... 300/21; 15/183

[58] Field of Search ..... 300/21; 15/179, 182, 15/183 X

[56] References Cited

U.S. PATENT DOCUMENTS

| | | | |
|---|---|---|---|
| 2,136,103 | 11/1938 | Herold | 300/21 |
| 2,303,386 | 12/1942 | Peterson | 300/21 X |
| 2,511,004 | 6/1950 | Peterson | 300/21 X |
| 2,757,400 | 8/1956 | Peterson | 300/21 X |
| 2,767,418 | 10/1956 | Lombardi | 15/183 |
| 2,778,047 | 1/1957 | Nielsen | 300/21 X |
| 2,778,048 | 1/1957 | Nielsen | 300/21 X |
| 2,921,329 | 1/1960 | Peterson | 15/183 X |
| 2,978,726 | 4/1961 | Park | 15/183 |
| 3,002,212 | 10/1961 | Tilgner | 300/21 X |
| 3,241,172 | 3/1966 | Tilgner | 15/183 |
| 3,715,773 | 2/1973 | Drumm | 15/183 |
| 3,862,462 | 1/1975 | Reiter | 15/182 |
| 4,142,267 | 3/1979 | Clark | 15/179 |
| 4,490,877 | 1/1985 | Drumm | 15/182 |
| 4,498,210 | 2/1985 | Drumm | 15/183 |
| 4,955,102 | 9/1990 | Cousuns | 15/183 X |

FOREIGN PATENT DOCUMENTS

| | | | |
|---|---|---|---|
| 82431 | 11/1956 | Denmark | 15/183 |
| 109323 | 11/1960 | Fed. Rep. of Germany | 15/183 |
| 2218914 | 10/1973 | Fed. Rep. of Germany | 15/183 |
| 2707673 | 8/1978 | Fed. Rep. of Germany | 15/183 |
| 710230 | 6/1954 | United Kingdom | 300/21 |
| 779845 | 7/1957 | United Kingdom | 300/21 |
| 780225 | 7/1957 | United Kingdom | 300/21 |
| 790826 | 2/1958 | United Kingdom | 15/183 |

*Primary Examiner*—Mark Rosenbaum
*Assistant Examiner*—Frances Chin
*Attorney, Agent, or Firm*—Sidney W. Millard; William V. Miller

[57] ABSTRACT

A bristle strip for rotary brushes comprising a channel in which the closed ends of the U-shaped bristles are clamped. The channel is provided with pairs of opposed slots in its upstanding flanges or sides which receive guide lugs that project laterally outwardly to guide the strip when it is inserted in a guide track on a rotary drum and to retain it therein. Each lug is provided with an indentation for engaging the mat of bristles to hold the lug in a lateral fixed position. Due to the simple nature of the strip it can be produced at a low cost without special tooling.

16 Claims, 3 Drawing Sheets

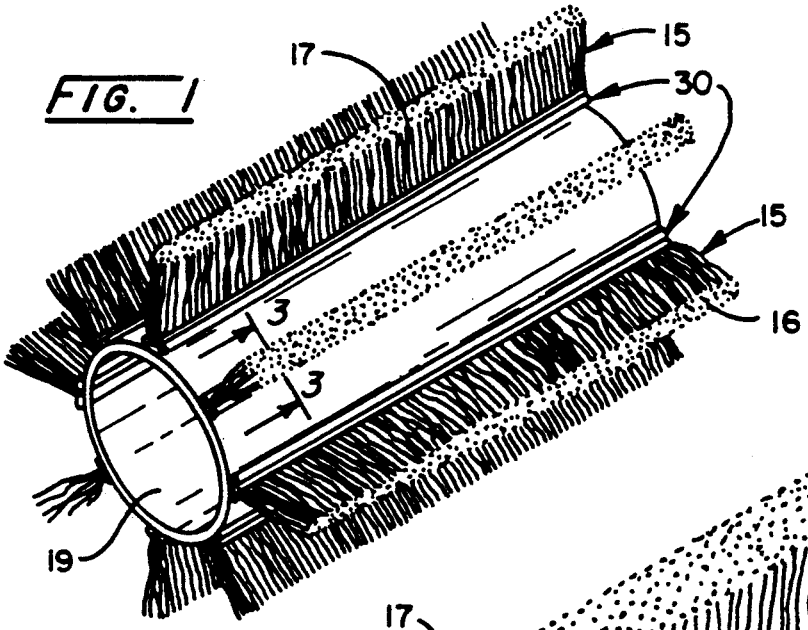
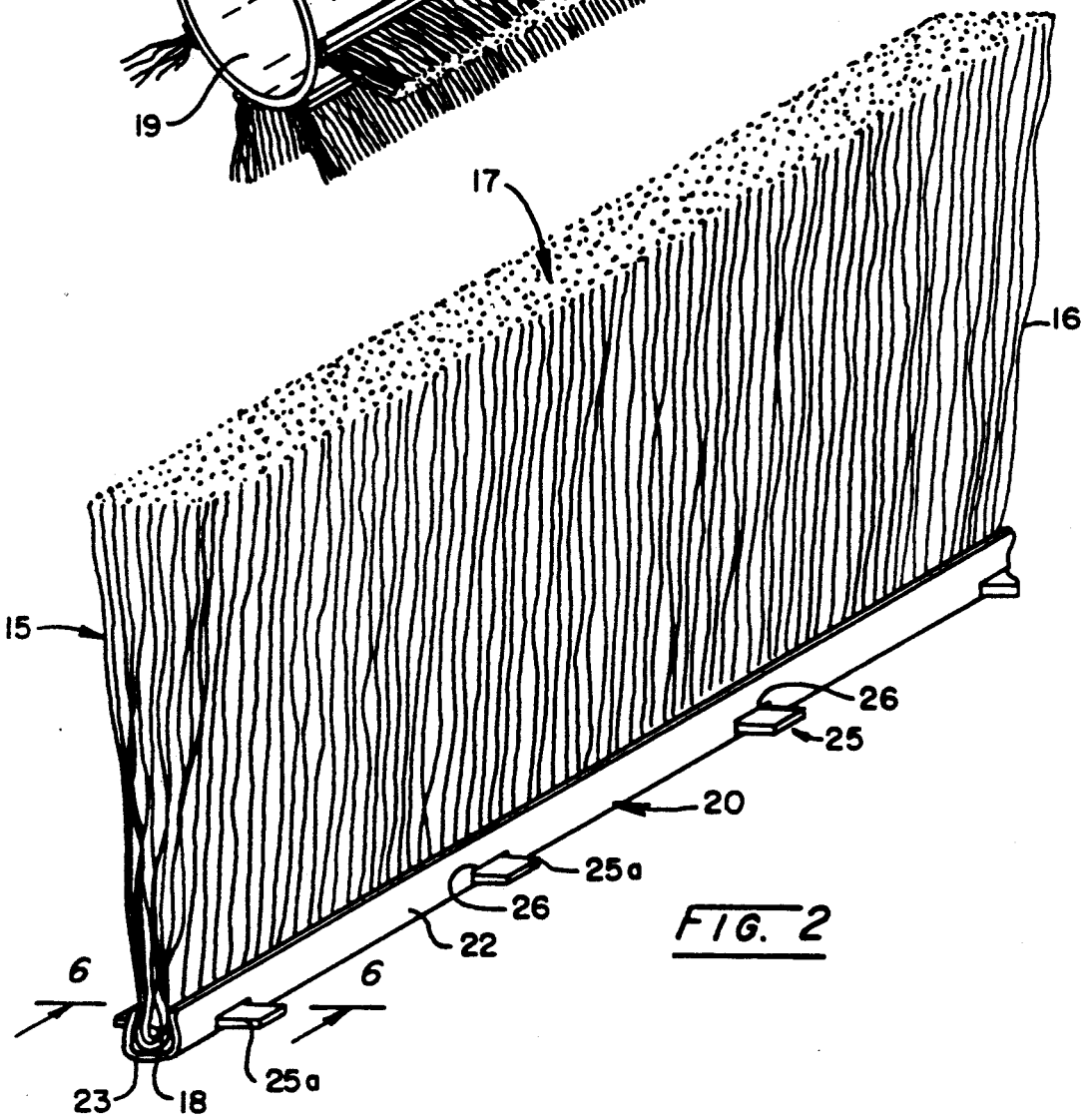
FIG. 2

STRIP BRUSH FOR MOUNTING ON A ROTARY DRUM

FIELD OF THE INVENTION

This invention relates to rotary brushes of the type comprising a drum upon which is mounted strips of bristles. The strips are mounted in tracks on the drum and can be removed for replacement when worn.

BACKGROUND AND PRIOR ART

Rotary brushes now commonly on the market and in use consist of a drum which carries bristle strips on its periphery. The strips are mounted in various ways on the drum and are usually removable so that they can be replaced after wear. It is important that the strip be of such a nature that it can be produced with simple tooling and at a low cost of time and material.

At present a popular brush strip is produced by a slow, costly method of providing a metal strip with holes punched at longitudinally spaced intervals which are to receive the bristles. The closed ends of U-shape bristles are bunched together and then inserted in these holes; the number of ends must be accurate so that the holes will be filled. The bristles are plastic and are retained in the holes by a heat process. This method of producing bristle strips is limited to plastic bristles and is difficult to perform and time-consuming. It also produces a weak strip that is difficult to handle, the weakness resulting from the successive holes. Due to this weakness, the strip tends to bend at longitudinal intervals from its plane and thus makes it difficult to handle in inserting it into the end of the receiving grooved track or channel on the drum. This track usually has opposed laterally spaced guide grooves for receiving laterally-extending flanges on the bristle strip.

Another method forms a strip for sliding into a track on the drum by double-joining,, back-forming, etc. to provide an outwardly-opening, bristle-receiving channel with laterally extending lower flanges adapted to slip in the laterally extending grooves of the drum-mounted tracks. This method requires expensive tooling and produces a weak arrangement that results in a leverage problem during rotation of the drum tending to spring apart the flanges of the outwardly-opening bristle-receiving channel and thereby release the bristles.

Many other forms of tracks are provided on drums in the prior art to receive bristle carrying strips. This invention provides a strip which can slip in any guide track that provides laterally opposed receiving guide grooves which extend longitudinally of the track.

The present invention provides a strip brush for mounting on a rotary drum which is of simple construction and can be removably slipped readily into tracks of the type now usually provided on rotary drums. This bristle strip can be produced without high-cost materials, and expensive tooling and time-consuming operations resulting in a low cost strip. It can be inserted readily in the drum track, will be effectively retained therein and can be removed with ease when it is necessary to replace it. The bristle strip is stronger and easier to install and remove as compared to prior art strips and as indicated above is less costly to produce.

SUMMARY OF THE INVENTION

The bristle strip of this invention is of channel form and receives a mat of bristles of U-form having a retaining wire running through the U ends of the mat bristles as in the prior art. This mat of bristles is retained in the carrying channel by crimping of the sides or flanges of the channel. For mounting in the drum-carried track the upstanding sides or flanges of the channel are provided with pairs of opposed slots which receive guide lugs that project laterally from each side or flange of the outwardly extending sides or flanges of the channel. These laterally-projecting guide lugs provide guide ears which will project slidably into the laterally-opposed guide grooves of the track. This bristle strip can be economically produced from a flat strip of metal which is perforated to provide the holes in the channel which is subsequently formed from the flat strip by a simple bending operation.

BRIEF DESCRIPTION OF THE DRAWINGS

The best mode contemplated in carrying out this invention is illustrated in the accompanying drawings in which:

FIG. 1 is a perspective view of a drum having bristle strips of this invention mounted thereon in straight parallel angularly spaced relationship;

FIG. 2 is a perspective view of the bristle strip of this invention;

DETAILED DESCRIPTION OF THE INVENTION

Figure 6:
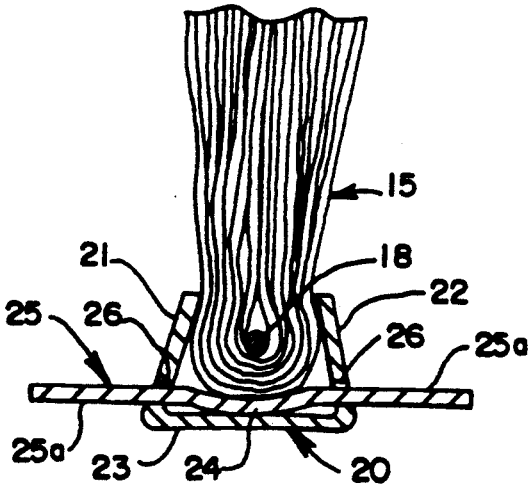
FIG. 6 is an enlarged transverse sectional view taken along line 6—6 of FIG. 2.

With reference to the drawings, the bristle strip of this invention is shown in detail in the drawings and is designated generally by the number 15. Each strip consists of the bristle receiving and carrying channel 20 into which the U-form bristles 16 of the mat of bristles designated generally at 17 are inserted. A retaining wire 18 passes longitudinally through the closed ends of the bristles 1 to retain them in the channel 20 which in its final form has the parallel upstanding sides or flanges 21 and 22 that are crimped into contact with the bristle mat 17 outwardly of the wire 18. The mat 17 may be formed of U-shape bristles 16 which are of metal, plastic or other suitable material. At longitudinally spaced intervals guide lugs 25 are passed through opposed slots 26 in the walls 21 and 22 of the channel 20 just above the bottom wall 23 of the channel. The projecting ends of the lugs 25 provide guide ears **25*a* which will extend into the opposed guide grooves of the drum-mounted tracks 30 (FIG. 1) as will be explained later. Each lug 25 is provided with a curved depression or indentation 24 midway of its length to hold it in a fixed position laterally of the channel 20 when the bristle mat 17 is inserted in that channel and is crimped into engagement with the mat (FIG. 6). This causes the curved lower ends of the bristles 16 to be forced downwardly into the curved indentations 24 to lock the lugs in fixed lateral positions as shown in FIG. 6. Each indentation 24 is formed transversely in each lug 25 to provide a transverse groove for receiving the lower curved end of the mat 17. The curved lower side of the indentation 24 forms a boss which will contact the bottom 23 of the channel 20**.

An alternative embodiment, not illustrated, may include two parallel channels 20 with their edges abutting. The lug 25 is longer than illustrated in FIG. 6 to extend through aligned slots 26 in both juxtaposed channels. The resulting strip is somewhat stiffer and the radially projecting bristles are more dense at the periphery of the brush unit.

Figure 3:
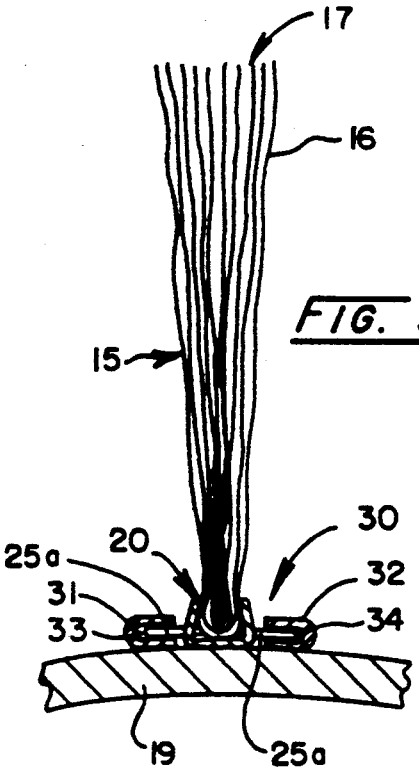
FIG. 3 is an enlarged transverse sectional view taken along line 3—3 of FIG. 1 having one type of drum track into which the bristle strip of this invention is slipped.

One form of track is indicated at 30 in FIG. 1 where several of the tracks are shown on the drum 19 in straight angularly spaced positions where they may be welded or otherwise secured to the drum as indicated in FIG. 3. The track 30 in this instance is composed of U-shape metal sections 31 and 32 secured around the drum in parallel spaced positions to form the opposed inwardly opening guide grooves 33 and 34 which will receive the ears 25. The track sections 31 and 32 may be of metal or plastic and be secured to the drum by various means.

Figure 4:
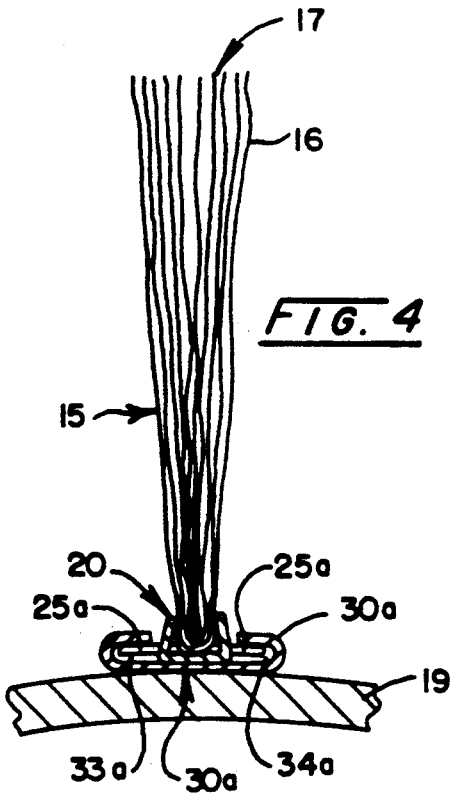
FIG. 4 is a similar view showing a different form of track with the bristle strip of this invention inserted.

FIG. 4 shows another form of track **30*a* which is shaped to provide the laterally opposed guide grooves 33*a* and 34*a* for receiving the guide ears 25*a* of the bristle strip 20. The track is welded or otherwise secured to the drum 30**.

Figure 5:
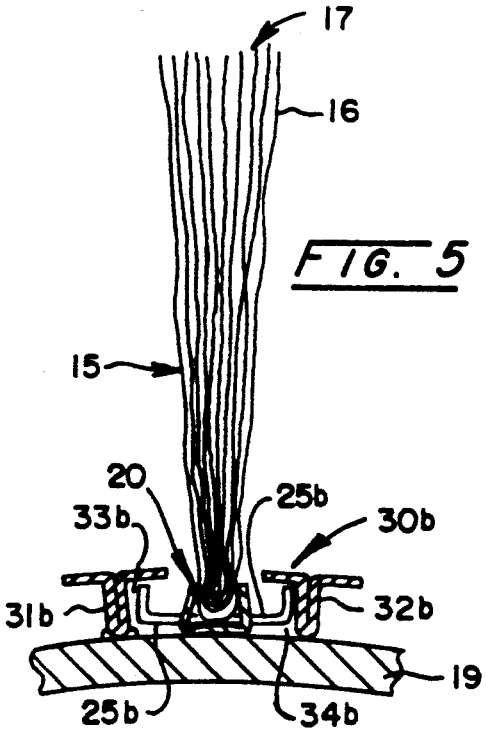
FIG. 5 is a similar view showing the bristle strip inserted into a different form of track.

In FIG. 5 a different form of prior art track **30*b* may be provided on the drum 30. This provides the guide grooves 33*a* and 34*a* by welding to the drum 30 inverted T-shape strips 31*a* and 32*a*. In this instance the ends of the lug ears 25*a* are bent upwardly after insertion so as to fit snugly in the respective grooves 33*b* and 34*b***.

The bristle strip 15 of this invention will slide into any track on the drum or other object which has the spaced laterally opposed guide grooves that provide a socket for receiving the channel 20 of the bristle strip 15 and the opposed inwardly-opening guide grooves which will receive the opposed guide ears extending from the strip. In each case inserting and crimping the mat 17 of bristles in the channel 20 will press the lower curved end of the bristles 16 into indentations 24 to lock the guide lugs 25 laterally in position in the channel so that guide ears **25*a*** will project.

Figure 9:
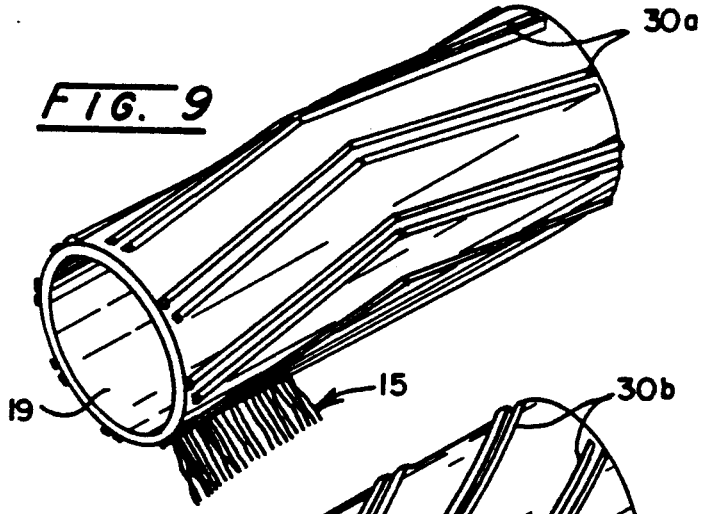
FIG. 9 shows a herringbone arrangement of the strips on a drum.
Figure 10:
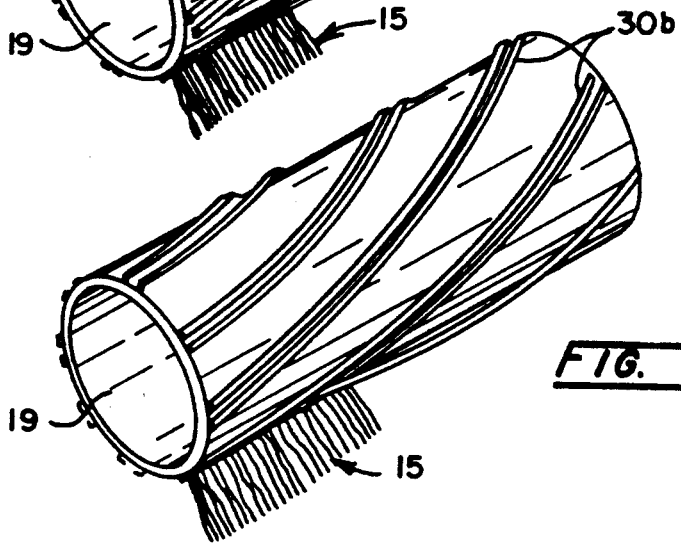
FIG. 10 shows the strips on the drum extending helically of the drum.

As indicated the bristle strips 15 may be positioned on the drum 19 in various arrangements depending upon the arrangement of the guide tracks on the drum. In FIG. 1 the strips 15 are of straight form and are inserted in the straight angularly spaced guide tracks 30. The strips will be sufficiently strong to facilitate this insertion. In FIG. 9 the tracks **30*a* are arranged on the drum in a herringbone relationship. In FIG. 10, the tracks 30*b* are arranged in a curved helical pattern on the drum 31. The strips 15 are relatively stiff to permit the straight insertion into the tracks 30 and 30*a* but are capable of being twisted about their longitudinal axes for inserting them into the curved tracks 30*b* and for bending in the herringbone pattern 30*a*** of FIG. 9.

Figure 7:
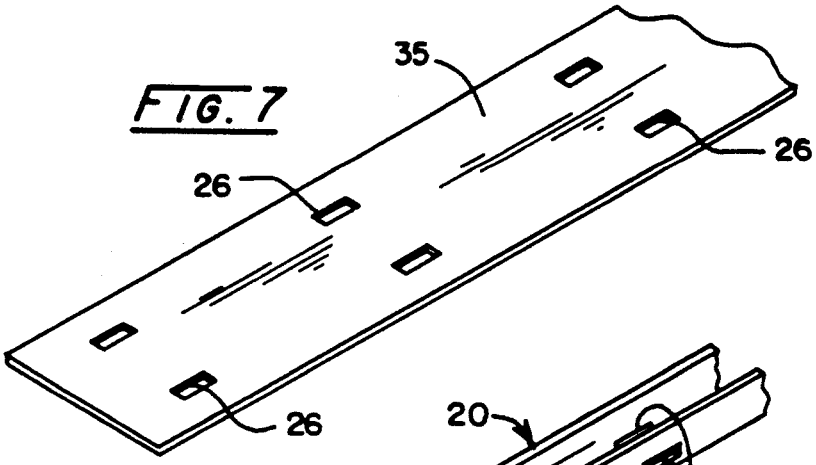
FIG. 7 shows a flat strip which can be used in forming the channel that carries the bristles.
Figure 8:
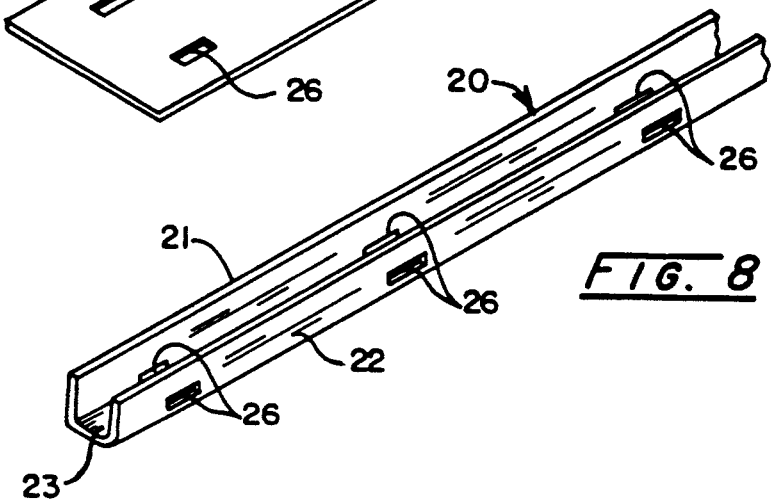
FIG. 8 shows the channel after it is formed from the flat strip.

As indicated, the bristle strip 15 is of such a nature that it can be produced by a simple low-cost method which is illustrated in FIGS. 7 and 8. It is produced from a flat elongated strip of metal 35 by a stamping or other operation which forms two parallel rows of slots 26. These slots are arranged as laterally opposed pairs at longitudinally spaced intervals. The strip 35 is then formed into the channel 20 by forming rolls or other forming means. This positions the slots 26 of each pair directly opposite each other in the respective upstanding flanges 21 and 22 of the channel. Also, it will be noted that these slots are located just above the bottom 23 of the channel. Thus, the channel 20 with the slots 26 formed therein can be produced by a simple low-cost method which does not require expensive tooling.

It will be apparent from the above description that the bristle strip of this invention is a simple structure in the form of a single channel which receives the bristle mat that is retained therein by crimping the sides of the channel. At longitudinal intervals the channel side walls are provided with slots for receiving guide lugs which project laterally and will fit into most drum tracks now in use. These lugs are held in fixed lateral position by a locking means which functions when the mat of bristles is positioned in the channel. The nature of the bristle strip permits production at a very low cost without special tools.

Although this bristle strip was intended for use mainly on rotary drums, it could be used for other applications.

I claim:

1. A method of producing a bristle strip which comprises providing an elongated formable flat strip and forming therein longitudinally spaced pairs of laterally-opposed slots with the slots being arranged in rows adjacent each edge o the strip and located a predetermined distance from each edge, forming the strip into a channel of U-form with upstanding side flanges and a bottom, said distance being such that when the strip is formed the slots will be just above said bottom as determined by said predetermined distance and securing a mat of U-shaped bristles having a closed end and an open end, the closed end being enclosed in said channel, passing lugs through said slots for engagement with the exterior surface of said closed end of said bristle mat and with the ends of said lugs projecting outwardly beyond the side flanges to provide outwardly extending guide ears, indenting the lugs transversely to receive the lower end of said U-shaped bristle mat which is positioned in said channel, and contacting the opposite side of the lug from the indentation with said bottom of said channel.

2. The method of claim 1 including bending the guide ears upwardly.

3. The method of claim 1 which includes the step of securing said bristle strip to a circular drum.

4. The method of claim 15 wherein said securing step includes providing a guide track on said drum to receive said guide ears, said track comprises two U-shaped metal pieces forming opposed guide grooves.

5. The method of claim 3, wherein said securing step includes providing a guide track on said drum top receive said guide ears, said track comprises a single piece of metal shaped with two opposed U-shaped guide grooves.

6. The method of claim 3 wherein said securing step includes providing a guide track on said drum to receive said guide ears, said track comprises two T-shaped metal pieces forming opposed guide grooves.

7. The method of claim 3 in which the securing step includes providing a guide track on said drum to receive said guide ears.

8. The method of claim 7 including aligning the guide track on the drum in a straight line and the bristle strip is straight after being positioned therein.

9. The method of claim 7 including securing a plurality of tracks on the drum and aligning said tracks as straight sections arranged in herringbone from, and inserting in each section a bristle strip.

10. The method of claim 7 including securing a plurality of tracks on the drum and aligning said tracks as curved sections extending helically around the drum, and positioning a bristle strip in each of said curved sections.

11. The method of claim 7 including securing the guide track on the drum in a straight line and the bristle strip is straight after being positioned therein.

12. The method of claim 7 including securing a plurality of tracks on the drum and aligning said tracks as straight sections arranged in herringbone form, and positioning a straight bristle strip in each section.

13. The method of claim 7 including securing a plurality of tracks on the drum and aligning said tracks as curved sections extending helically around the drum, and positioning a bristle strip in each curved section.

14. The method of claim 7 including securing the guide track on the drum in a straight line and positioning the bristle strip in a straight line therein.

15. The method of claim 7 including securing a plurality of tracks on the drum, aligning said tracks as straight sections arranged in herringbone form, and positioning a straight bristle strip in each of said straight sections.

16. The method of claim 7 including securing a plurality of tracks on the drum, arranging said tracks as curved sections extending helically around the drum, and positioning a bristle strip in each of said curved sections.

* * * * *